United States Patent [19]

Whitley et al.

[11] Patent Number: 4,723,432

[45] Date of Patent: Feb. 9, 1988

[54] TAB TWISTING DEVICE

[75] Inventors: George J. Whitley, Philadelphia; Joseph A. Pierro, Levittown, both of Pa.

[73] Assignee: RCA Corporation, Princeton, N.J.

[21] Appl. No.: 11,483

[22] Filed: Feb. 5, 1987

[51] Int. Cl.[4] ..... B21D 31/02

[52] U.S. Cl. ..... 72/325; 72/387; 72/464; 29/513; 29/283.5

[58] Field of Search ..... 72/324, 325, 388, 387, 72/464; 29/513, 243.5, 283.5

[56] References Cited

U.S. PATENT DOCUMENTS

| | | | |
|---|---|---|---|
| 468,584 | 2/1892 | Symonds . | |
| 2,426,340 | 8/1947 | Bush | 72/387 |
| 2,990,734 | 7/1961 | Jackson | 81/3 |
| 3,062,261 | 11/1962 | Chesser | 29/513 |
| 3,190,250 | 6/1965 | Hinden | 113/1 |
| 3,847,189 | 11/1974 | Guzda | 72/464 |
| 4,034,595 | 7/1977 | Smith | 72/458 |
| 4,181,002 | 1/1980 | Eckhold et al. | 72/387 |
| 4,208,776 | 6/1980 | Schleicher | 29/243.5 |
| 4,228,583 | 10/1980 | Noesen et al. | 29/513 |
| 4,377,026 | 3/1983 | Whitley | 29/564.1 |
| 4,462,435 | 7/1984 | Whitley | 140/105 |
| 4,464,829 | 8/1984 | Whitley et al. | 29/741 |
| 4,513,493 | 4/1985 | Whitley et al. | 29/566.3 |
| 4,520,549 | 6/1985 | Whitley et al. | 29/566.3 |
| 4,557,043 | 12/1985 | Starski | 29/741 |
| 4,561,166 | 12/1985 | Whitley | 29/566.3 |
| 4,569,127 | 2/1986 | Whitley | 29/741 |

*Primary Examiner*—Robert L. Spruill
*Assistant Examiner*—David B. Jones
*Attorney, Agent, or Firm*—Allen L. Limberg; William Squire

[57] ABSTRACT

A bending device has a slot defined by facing side walls which taper from a reference plane in a direction to widen the slot proportionately with the slot depth to form two opposed facing bending edges. The angle the side walls taper from the reference plane is significant wherein each angle is within a range defined by a minimum value to assure the edges penetrate and sever the tab at its extremities and a maximum value to insure the tab is not completely severed during bending.

12 Claims, 7 Drawing Figures

TAB TWISTING DEVICE

This invention relates to apparatus for bending tabs.

Of interest are U.S. Pat. Nos. 4,520,549; 4,557,043; 4,569,127; 4,464,829; 4,513,493; 4,462,435; 4,561,166; and 4,377,026.

Sheet metal elements, in many constructions, are attached by tabs to other structures including sheet material such as printed circuit boards. The tab passes through a slotted aperture of the supporting structure. The projection portion of the tab is bent or twisted out of alignment with the aperture to lock the sheet metal element to the supporting structure. By way of example, sheet metal bending devices are illustrated in U.S. Pat. Nos. 468,584; 4,181,002; 2,990,734; 4,034,595; and 3,190,250.

Normally, the bending of tabs is a simple task in which the bending tool comprises a structure having a slot. The tab to be bent is inserted in the slot and then the tool is rotated. The rotation bends the tab about the axis of rotation deforming the tab sufficiently to provide locking displacement of portions of the tab.

Some tabs are provided with boots. These tabs are L-shaped members having a relatively small shank portion which is passed into an aperture in the supporting structure and a boot portion extending at right angles to the shank portion and projecting beyond the supporting structure. The boot portion is easily bent because of its extension beyond the shank portion. In other structures, the tab may comprise a rectangular extension extending from a sheet metal structure. That rectangular tab passes through the supporting structure aperture and does not include a projecting boot portion. It is this latter tab structure which becomes extremely difficult to bend when the projecting portion has a relatively short length.

A problem occurs when the tab projecting portion to be twisted is relatively short. Because of differences in tolerances in the tools and supporting structure, there may be some displacement of the tab relative to the tool during the bending action which may cause the tab to displace out of the tool slot. That is, if the depth of the tab into the bending tool slot is shallow due to the tab's short length, the tab may slip or otherwise jump out of the slot during the bending action due to the inherent bending forces and the resistance of the tab material to bending. Disengagement of the tab from the slot may also be due to some flexing of the supporting substrate to which the sheet metal element is to be attached, such as printed circuit substrates. Tabs having lengths of about 0.050 inch are extremely difficult to twist bend.

A bending device according to the present invention comprises a shank which is adapted to be rotatably secured to a support for rotation about an axis. A bending head secured to the shank has a slot in a surface thereof. The slot has a depth in a direction parallel to the axis and has first and second facing spaced side walls. Each side wall and the surface terminate at respective spaced facing edges. The axis lies in a first plane parallel to the depth direction. Each side wall lies in a second plane which intersects the first plane at a given angle lying in a range of values. The range of values has a minimum value such that rotation of the head relative to a member fixed in place in and relative to the slot tends to shear the member at a region spaced distal from the axis and has a maximum value such that rotation of the head relative to the member tends to twist and bend the member at a proximal region adjacent to and on the axis. The given angle tends to cause the device edges to grab the member and pull the member into the slot during the bending.

Figure 5A:
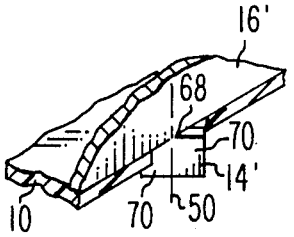
Figure 5B:
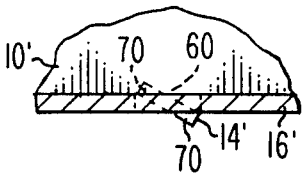

FIG. 5*a* is an isometric view of a twist tab which is bent by the device of the present invention;

FIG. 5*b* is a plan view of the structure of FIG. 5*a*; and

Figure 6:
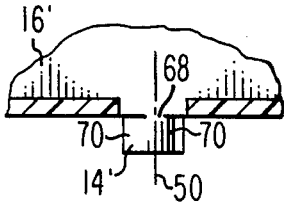

FIG. 6 is a side elevation view of the embodiment of FIG. 5*b*.

Figure 1:
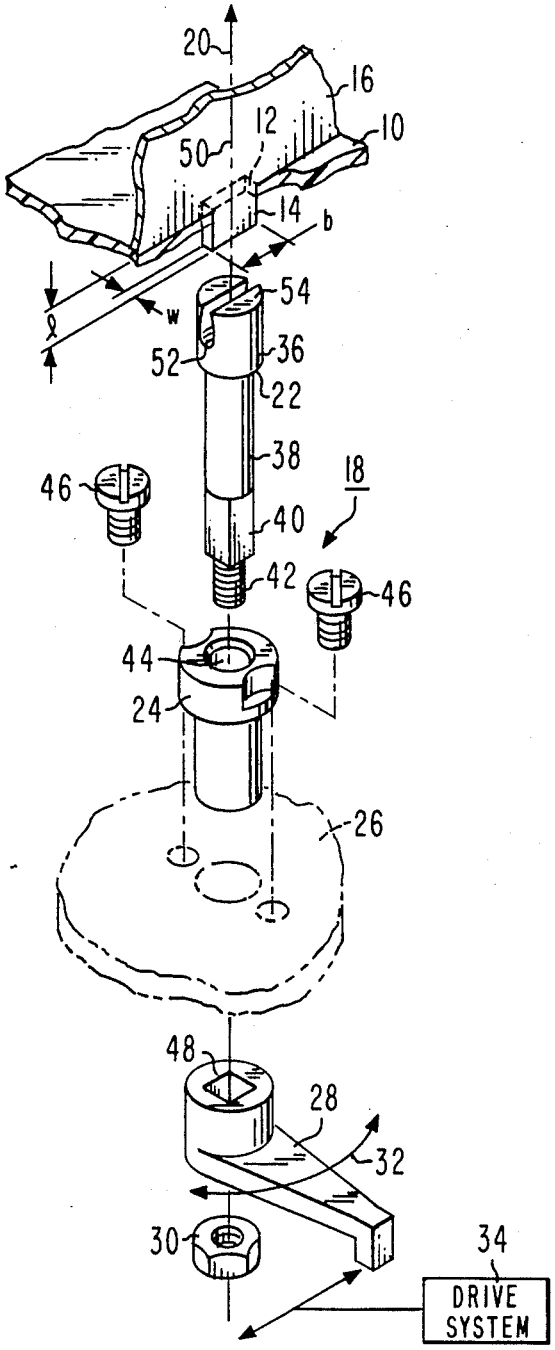
FIG. 1 is an isometric view, partially diagrammatic, of a system of a bending device and operating system in accordance with one embodiment of the present invention.

In FIG. 1, the substrate 10 which is relatively thin sheet material such as, for example, a printed circuit board, has a rectangular aperture 12 which receives a tab 14 of a sheet material element 16 which may be a metal frame. The tab 14 projects beneath the substrate 10 passing through the rectangular aperture 12. A tab bending system 18 twists the tab 14 out of its plane to lock the sheet element 16 to the substrate 10. The tab 14 projects a distance l from beneath the substrate 10, which distance may be relatively small, for example, 0.050 inch. The tab may have a width w which may lie in the range of about 0.030 to 0.050 inch. The tab may have a breadth b which may be about $\frac{1}{8}$ inch to $\frac{1}{4}$ inch. Tab 14 is integral with the sheet element 16 for the entire breadth b.

In some cases, the element 16 may be made of sheet steel and the relatively short length l as compared to the high tensile stress of such steel makes the bending of the tab 14 relatively difficult. The reason for this difficulty is that in the process of bending or twisting the tab 14 the tab tends to bend and distort at the region where it is attached to the body of sheet element 16. This bending may cause the bending tool to disengage from the tab and create a relatively poorly twisted tab. The disengagement is believed due to the reaction forces created within the material of element 16 during bending which tends to push the tab 14 and element 16 in direction 20 away from the tab bending system 18. This pushing action in direction 20 is a contributing factor in disengaging the tab 14 prior to the completion of the bending cycle and, therefore, is recognized as a cause of the poor bend. The solution to this problem, as recognized by the present invention, is to provide a bending device which can grab and bend the tab 14 without disengagement during the bending motion.

The tab bending system 18 according to one embodiment of the present invention includes a bending device 22 and a bearing 24 which rotatably secures the device 22 to a fixed support 26 shown in phantom. A drive lever 28 is secured to the bending device 22 by nut 30. The lever 28 is selectively rotated in one and then the other of directions 32 about axis 50 by drive system 34. Drive system 34 is the type disclosed in U.S. Pat. No. 4,520,549 and others of the patents of interest mentioned in the introductory portion, and that drive system is incorporated by reference. The drive lever 28, bearing 24 and the manner of the attachment of the lever 28 and bearing 24 to the bending device 22 is similar to that described in connection with the embodiment disclosed in FIG. 5 of the aforementioned U.S. Pat. No. 4,520,549. The drive system 34, lever 28, and bearing 24 will not be further described herein, as the details thereof and their operation including the drive system 34 are described fully in the aforementioned patents.

The bending device 22 includes a bending head 36, a shank 38, a square-in-section drive section 40, and a threaded stud 42. Shank 38 is rotatably received within circular cylindrical journal bearing 44 of bearing 24. The bearing 24 is secured to support 26 by screws 46. The lever 28 has a square opening 48 which closely receives drive section 40 of device 22. Nut 30 secures the lever 28 to shank 38 via stud 42. Device 22, when secured to bearing 24, rotates about axis 50. Drive system 34 rotates lever 28 in a partial revolution in one of directions 32 and then immediately returns the lever in the opposite angular direction to the starting position. The operation of this system is as described more fully in the aforementioned U.S. Pat. No. 4,520,549. The device 22 includes a bending slot 52. Slot 52 passes diametrically through the circular cylindrical head 36 planar end face 54. Slot 52 is symmetrical relative to axis 50.

Figure 4:
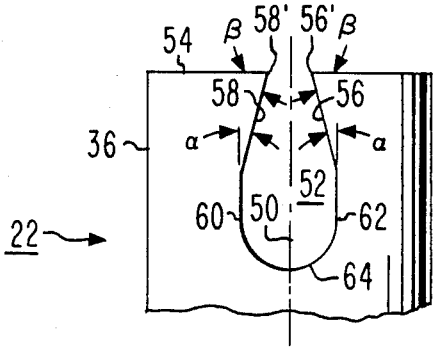
FIG. 4 is an enlarged side elevation view of the bending tool of the present invention.

In FIG. 4, slot 52 is defined by a pair of facing opposed side walls 56 and 58 which taper at an angle $\alpha$ to a plane passing through axis 50 parallel to slot 52. Preferably, side walls 56 and 58 taper at the same angle $\alpha$ to that plane but may taper to that plane within a range of angle values which lie in a preferred range of 10°–20°. Side walls 56 and 58 intersect surface 54 at sharp edges 56' and 58', respectively. The surface 54 is normal to axis 50 and thus forms an angle $\beta$ with respective side walls 56 and 58. Angle $\beta$ may lie in the range of 70°–80°. The edges 56' and 58' are preferably sharp and, to that extent, may be broken by having a flat of a length of about 0.005 inch at the extreme edge portion of the edges.

Side wall 58 tapers to side wall 60 and side wall 56 tapers to side wall 62, walls 60 and 62 being generally parallel to axis 50. Walls 60 and 62 are joined by arcuate bottom wall 64.

The end view of slot 52 appears somewhat teardrop shaped with the narrowest width occurring between edges 56' and 58'. The spacing between edges 56' and 58' may be slightly greater than the width w of the tab 14, FIG. 1. Walls 56 and 58 have a depth into the slot an amount which is greater than the length l of the tab 14 and preferably about double that length. The walls 60 and 62 are of about the same depth as walls 56 and 58 in a direction parallel to axis 50.

As mentioned previously, one problem with the prior art bending devices is that they tend to disengage from relatively short length tabs during the twisting motion when the tabs are relatively high strength material such as steel. The bending device of the present invention tends to overcome that problem and, to this extent, the angle $\alpha$ of the side walls 56 and 58 is significant. Normally, in prior art tools the side walls of the bending tool at the bending slot are parallel to the slot depth and thus to axis 50. By making the side walls 56 and 58 tapering outwardly proportionately as the side walls extend into the slot, the edges 56' and 58' perform an important function in insuring positive engagement of the tool during the bending process.

Figure 3:
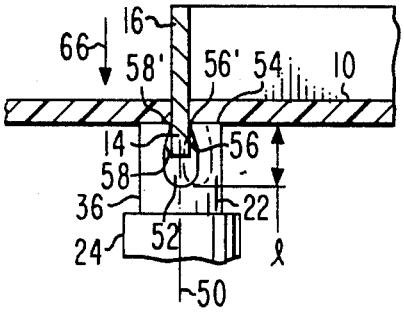
FIG. 3 is an elevation sectional view showing the relationship of the bending tool to the member to be bent in more detail.

In FIG. 3, the edges 58' and 56' tend to bite into the tab 14 at a point where the tab is flush with the lower surface of the substrate 10, the upper surface 54 of the device 22 head 36 abutting that substrate lower surface. This action grabs the tab and tends to pull on the tab in a direction into the slot during the bending. This avoids the tab jumping out of the slot as occurs in prior art systems. Thus, even relatively short tabs are processed by the device 22. As the head 36 rotates about axis 50, the edges 56' and 58' tend to cut and pierce the material of tab 14. The importance of angle $\alpha$ is relevant to this action. If the angle $\alpha$ were too shallow, for example, 0°, so that the side walls 56 and 58 were parallel to axis 50, then negligible biting or cutting action may take place. The tool head may tend to wipe over the tab material and be forced in direction 66 out of engagement with the tab. During this action, the bending forces tend to flex the substrate 10 in the opposite direction which may push the tab out of engagement with the device slot. This disengagement tends to increase in severity as the angle $\alpha$ decreases below the lower angular limit of 10°.

Should the angle $\alpha$ be larger than 20°, for example, 45°, then the edges 56' and 58' tend to be knife-like and as the head 36 rotates, these knife-like edges tend to completely shear off the projecting portion of the tab 14 within the slot 52. By making the angle $\alpha$ no more than about 20°, the side walls 56 and 58, after some shearing action occurs at regions of the tab distal axis 50, abut the projecting portion of tab 14 within slot 52 and push against that projecting portion (bending it) prior to complete severence of that projecting tab portion from the remainder of the tab. After a partial revolution of the head 36 (as shown in phantom in FIG. 3), most of the tab 14 engages the side walls 58 and side wall 56. Thus, the angle $\alpha$ within the range of 10–20° tends to cause the tab 14 to shear at its extreme edges distal axis 50 while permitting the tab to remain intact where joined to the remainder of element 16 adjacent axis 50. The bent tab is shown in FIGS. 5*a*, 5*b*, and 6. In FIG. 5*a* the tab 14' is shown twisted in which a region 68 lying on axis 50 is intact while the tab regions 70 distal axis 50 are sheared from member 16'.

Figure 2:
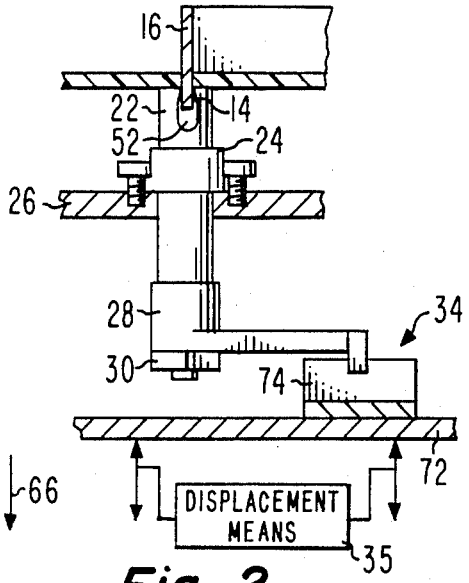
FIG. 2 is an elevation sectional view of a system in accordance with the embodiment of FIG. 1.

In FIG. 2, the drive system 34 includes a plate 72 which is displaced in a direction in and out of the drawing by an air cylinder (not shown). Secured to plate 72 is a bracket 74 which engages lever 28 at its extended end. The device 22 is rotated by the displacement of the plate 72 in and out of the drawing selectively by operation of the air cylinder (not shown). However, as the device 22 is rotated to bend the tab 14, the edges of the device 22 at slot 52 tend to cut into the tab at the tab end edges and lock the device 22 to tab 14. To release the device 22 from engagement with the tab 14, plate 72 and support 26 are lowered in direction 66 by displacement means 35 in a system, not shown, but described more fully in U.S. Pat. No. 4,377,026 incorporated by reference herein. The lever 28 is returned to its original starting position simultaneously with the lowering of support 26 and plate 72 in direction 66 by means 35. This lowering action disengages the device slot 52 edges 56' and 58' from the tab 14 in a somewhat screw-like action.

It is to be understood that the drive system 34 initially is at the lower position of directions 66 and engages the device 22 by means 35 initially raising the support 26 and drive plate 32, including device 22, in a direction opposite direction 66 until the tab 14 penetrates slot 52 as shown. After the tab 14 penetrates the slot 52, the device 22 is rotated a partial revolution. When the device 22 is then returned, the system 34 means 35 lowers the system described above. The depth, width, and other dimensions of slot 52 may differ from that described herein in accordance with a given implementation. The details of the bending device and the drive system given herein are by way of illustration rather than limitation.

What is claimed is:

1. A bending device comprising:

a shank adapted to be rotatably secured to a support for rotation about an axis;

a bending head secured to the shank having a slot in a surface thereof, said slot having a depth in a direction parallel to the axis, said slot having first and second facing spaced side walls, each side wall and said surface terminating at respective spaced edges, said axis lying in a first plane parallel to said depth direction, each side wall lying in respective second and third planes which intersect the first plane at given angles each lying in a range of values, said range of values each having a minimum value such that rotation of the head relative to a member fixed in place in and relative to said slot tends to shear the member at a region spaced distal from said axis, said given angles each having a maximum value such that rotation of the head relative to said member tends to twist and bend the member at a proximal region adjacent to and one said axis, said given angles tending to cause the device edges to grab the member and pull the member into the slot during the bending; and a lever secured to said shank extending in a direction normal to said axis.

2. The device of claim 1 wherein said minimum value is about 10° and said maximum value is about 20°.

3. The device of claim 1 wherein said side walls are planar and equidistant to said first plane.

4. The device of claim 1 wherein said slot has a bottom wall distal said edges, said side walls extending at said given angle for a first portion of the slot adjacent to said edge and extend in a direction parallel to said first plane for a second portion adjacent to said bottom wall.

5. The device of claim 1 wherein said shank includes a circular cylindrical portion having first and second ends, said head being attached to said shank first end, said lever being attached to said shank second end, and bearing means secured to said shank between said ends having a bearing journal rotatable receiving said shank therein.

6. A tab twisting device comprising:

a circular cylindrical member having first and second ends and a longitudinal axis;

a drive shaft having first and second ends secured to the member along said axis at said first ends;

a cylindrical twist head secured to the member second end, said head having a slot in an end surface thereof, said slot having a depth direction parallel to the axis, said slot having a pair of spaced facing side walls forming a corresponding pair of spaced facing edges with said surface, said axis lying in a plane, each side wall extending in a direction which intersects the plane at an angle in the range of about 10°–20° and said surface at said edges being at an angle to the corresponding side wall in the range of about 80°–70°, respectively, said angle being such that said edges tend to grab a tab inserted in the slot and pull the tab into the slot during twisting of the tab; and a lever attached to said drive shaft and extending in a direction normal to said axis.

7. The device of claim 6 further including a drive system comprising a fixed plate to which said cylindrical member is rotatably secured for rotation about said axis, a movable plate which moves in directions normal to said axis, link means coupling said movable plate to said drive shaft and means for displacing the movable plate in directions to impart a partial revolution to said head in one direction and then in the opposite direction.

8. The device of claim 7 further including means for displacing said drive system in directions parallel to said axis while simultaneously displacing the head in said opposite direction.

9. A tab twisting system comprising:

a circular cylindrical twist head having a planar end surface normal to the longitudinal axis of the cylinder forming said head, said head end surface having a slot symmetrical relative to said axis, said slot having a pair of inwardly facing opposed edges, one side wall of each edge being formed by said end surface, each edge being formed by a second side wall lying in a plane at an angle in the range of 10°–20° to said longitudinal axis, each said second side wall extending for a first given depth into said slot and terminating at a third side wall, each third side wall extending into said slot a second depth;

means for rotatably securing the head to a support; and means coupled to the support for selectively rotating the head first in one direction about said axis and then in the opposite direction.

10. The system of claim 9 wherein said slot has a given uniform width of a first value between said opposed edges, said first depth having a value of at least the first value.

11. The system of claim 9 wherein said slot has a width of a first value, said first and second depths having the same second value of about double the first value.

12. The system of claim 9 wherein said system includes a circular cylindrical shank depending from the head concentric with said axis and a head drive portion depending from said shank, and means for rotatably securing said shank to said support.

* * * * *